United States Patent [19]

Semler

[11] 4,120,256

[45] Oct. 17, 1978

[54] APPARATUS FOR SEALING FLANGE JOINTS

[76] Inventor: Joel H. Semler, 9202 Larston, Houston, Tex. 77055

[21] Appl. No.: 830,849

[22] Filed: Sep. 6, 1977

[51] Int. Cl.[2] ..... B21D 19/00

[52] U.S. Cl. ..... 113/57; 72/705

[58] Field of Search ..... 113/57; 72/705, 411, 72/479, 476, 478; 29/243.5, 243.58, 275

[56] References Cited

U.S. PATENT DOCUMENTS

| | | | |
|---|---|---|---|
| 2,591,980 | 4/1952 | Weiss et al. | 72/705 UX |
| 2,919,613 | 1/1960 | Crement | 72/479 X |
| 3,765,220 | 10/1973 | Kirspel | 72/460 |

FOREIGN PATENT DOCUMENTS

| | | | |
|---|---|---|---|
| 923,876 | 4/1963 | United Kingdom | 72/705 |

*Primary Examiner*—Leon Gilden
*Attorney, Agent, or Firm*—Guy E. Matthews

[57] ABSTRACT

A flanging tool used with an impact tool to attach a vehicular door panel to a door frame is disclosed. The flanging tool has a connecting end and a crimping end with means attached to the connecting end for connecting the shank to the impact tool. A hook is mounted with the crimping end of the shank for folding a door panel edge over and crimping the edge to the door frame lip. The hook has a flared lip to aid in folding the edge over the lip and a crimping portion to force the panel edge against the door frame lip. The crimping portion is of generally U-shaped cross-section with one side of the "U" extending into the shank and the other side of the "U" extending into the flared end which generally curves outwardly from the shank side. The folding and crimping of the edge to the door frame lip is accomplished by use of the impact tool.

6 Claims, 3 Drawing Figures

APPARATUS FOR SEALING FLANGE JOINTS

BACKGROUND AND SUMMARY OF THE INVENTION

In the repair of vehicles, a door panel quite frequently has to be removed from the door frame. One reason for this removal is that the door panel has been damaged which requires the door panel to be repaired or replaced. Another reason for this removal is that mechanical apparatus positioned within the door frame, such as the apparatus necessary to raise and lower the windows or the apparatus for opening, closing and locking the doors, must be repaired. The door panel is then attached to the door frame.

The conventional steps taken to attach a door panel to a door frame have been to remove the door frame and panel from the vehicular body, remove the door panel from the door frame and then replace the door panel on the door frame by using a hammer and dolly, and then attaching the door frame and panel to the vehicular body. This procedure is quite time consuming, which therefore makes it expensive. Moreover, to obtain results duplicating factory results, requires even more time, which is even more expensive.

Accordingly, it is an object of this invention to provide a flanging tool for attaching a vehicular door panel to a door frame which is easy to operate and effective in operation.

Further, it is an object of the invention to provide a flanging tool for attaching a vehicular door panel to a door frame without removing the door from the vehicular frame.

In accordance with the invention, a flanging tool is used to attach a vehicular door panel to a door frame when combined with an impact tool. The impact tool uses a rod having a connecting end and a retaining end and the weight is disposed around the rod and movable on the rod to provide a force at the connecting end by movement of the weight against a stop shoulder located at the retaining end. The flanging tool includes a shank having a connecting end with means attached at the connecting end of the shank for connecting the shank to the connecting end of the rod of the impact tool and a crimping end with a hook mounted thereon for folding a door panel edge over and crimping the edge to the door frame lip. The hook employs a flared end to aid in folding the edge and a crimping portion to force the panel edge against the door frame lip. The crimping portion is of generally U-shaped cross-section with one side of the "U" extending into the shank and the other side of the "U" extending into the flared end which generally curves outwardly from the shank side. The folding and crimping of the edge to the door frame lip is accomplished by movement of the weight of the impact tool against the stop shoulder.

BRIEF DESCRIPTION OF THE DRAWINGS

Other objects and advantages of the invention will become apparent upon reading the following detailed description and upon reference to the drawings, in which.

While the invention will be described in connection with the preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

Figure 1:
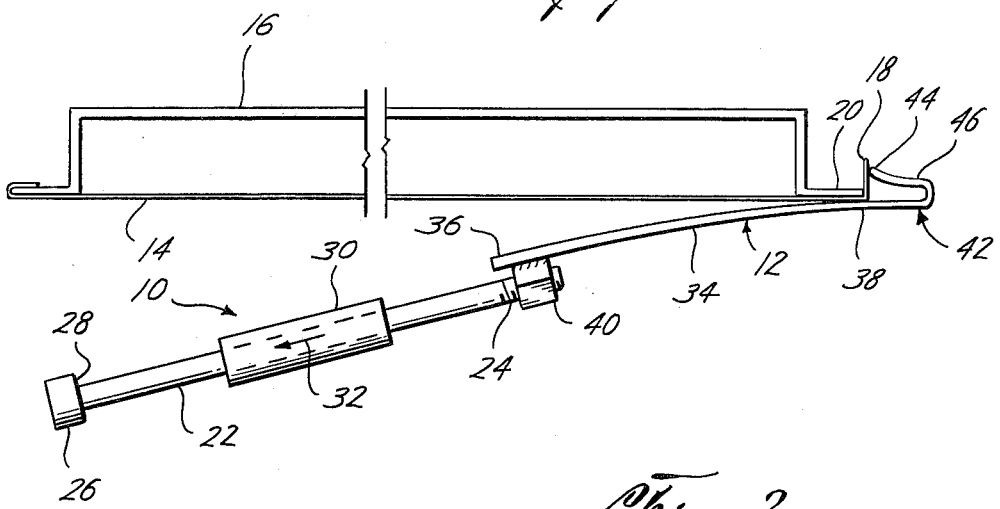
FIG. 1 is a plan view, partly in section, showing the position of the flanging tool and impact tool relative to the door panel edge and door frame lip prior to folding and crimping the edge.
Figure 2:
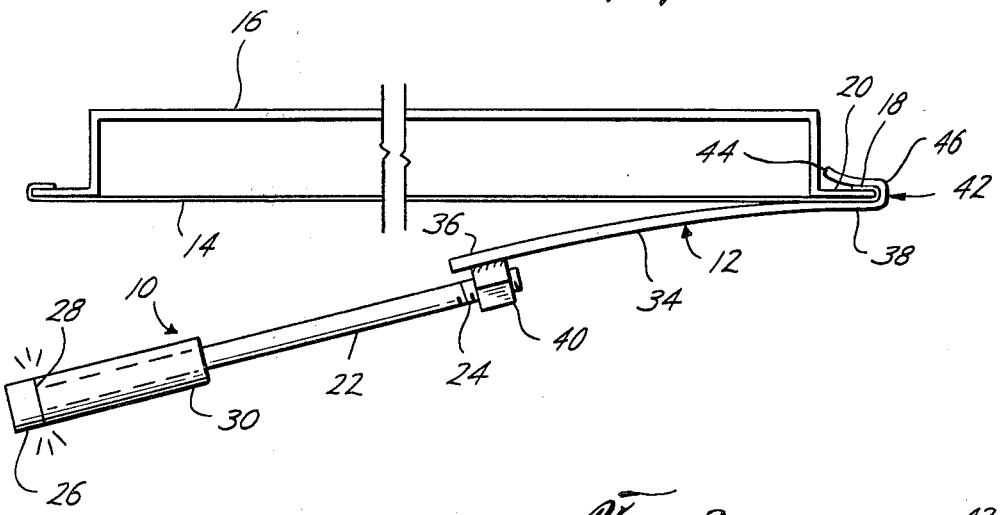
FIG. 2 is a plan view, partly in section, of the door panel and door frame shown in FIG. 1 with the door panel edge being folded and crimped against the door frame lip.
Figure 3:
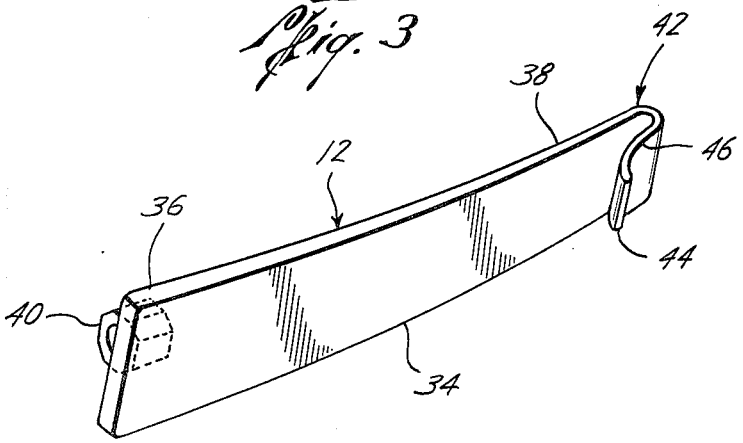
FIG. 3 is a perspective view of the flanging tool constructed according to the present invention and shown in FIG. 1.

Turning now to the drawings, an impact tool 10 is generally shown attached to a flanging tool 12. As shown in FIGS. 1 and 2, flanging tool 12 is used to attach a vehicular door panel 14 to a door frame 16 by folding and crimping a door panel edge 18 to a door frame lip 20.

Impact tool 10 is used to provide the force necessary to cause flanging tool 12 to fold and crimp edge 18. Impact tool 10 is of generally conventional design and includes a rod 22 with a connecting end 24 and a retaining end 26. Preferably, connecting end 24 is threaded to form a bolt from rod 22. Retaining end 26 may be constructed of sufficient length and width to use as a handle for impact tool 10, but will include a stopping shoulder 28. A weight 30 is disposed around rod 22 and is movable along the rod in the direction of arrow 32 to provide a force at connecting end 24 by movement of weight 30 against stop shoulder 28.

Flanging tool 12 includes a shank 34, which has a connecting end 36 and a crimping end 38. A connecting apparatus 40 is provided at connecting end 36 to connect shank 34 to connecting end 24 of impact tool 10. Preferably, connecting apparatus 40 is a nut welded to shank 34 at connecting end 36, which threadably engages the bolt formed from rod 22.

A hook 42 is mounted with crimping end 38 of shank 34 for folding door panel edge 18 over and crimping the edge to door frame lip 20. Hook 42 has a flared end 44 to aid in folding the edge over the lip and a crimping portion 46 to force the door panel edge over the door frame lip. Crimping portion 46 is of generally U-shaped cross-section with one side of the "U" extending into shank 34 at crimping end 38, while the other side of the "U" extends into flared end 44. Flared end 44 generally curves outwardly from the shank side of the crimping portion 46. Preferably, shank 34 is elongated with a distance between connecting means 40 and hook 42 sufficient to permit insertion of flanging tool 12 between an open door and a fender of the vehicle for use of the tool without the necessity of removing the door from the vehicle. More preferably, shank 34 is bent to form an arcuate shape for displacing retaining end 26 of impact tool 10 from door panel 14 and thereby inhibit damage to the door panel and the user's hand when attaching the door panel to the door frame by moving weight 30 against stop shoulder 28. Thus, folding and crimping of edge 18 to door frame lip 20 is accomplished by movement of weight 30 against stop shoulder 28.

Thus, it is apparent that there has been provided, in accordance with the invention, a flanging tool that fully satisfies the objects, aims and advantages set forth above. While the invention has been described with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. A flanging tool used in attaching a vehicular door panel to a door frame, that may be used with the door on or off of the vehicle, when combined with an impact tool having a rod with a connecting end and a retaining end, and a weight disposed around the rod and moveable along the rod to provide a force at the connecting end by movement of the weight against a stop shoulder located at the retaining end, comprising a shank of sufficient length to enable said flanging tool to be used on the door panel edge located inside the body cavity when the door is open, having a connecting end and a crimping end; means attached at the connecting end of said shank for connecting the shank to the connecting end of the rod of the impact tool; and a hook mounted with the crimping end of said shank having a flared end means of sufficient length for initially engaging a flanged edge of the door panel and beginning to fold the edge over a door frame lip; said flared end means generally curving outwardly from the shank side of said crimping portion and dimensioned for folding the edge over the lip; and a crimping portion means of generally U-shaped cross-section with one side of the "U" extending into the shank and the other side of the "U" extending into the flared end means, said crimping portion means being of sufficient length for progressively engaging the door panel edge as the flared end means folds the edge over the door frame lip and to progressively crimp the edge to the lip, the folding and crimping of the edge to the door frame lip being accomplished by movement of the weight against the stop shoulder.

2. The flanging tool of claim 1, wherein the rod of the impact tool is threaded at the connecting end to form a bolt and said connecting means of the flanging tool is a nut to threadedly engage the bolt.

3. The flanging tool of claim 1, wherein said shank is constructed to form an arcuate shape for displacing the retaining end of the impact tool from the panel to inhibit damage to the door panel when attaching the door panel to the door frame.

4. A device used to attach a vehicular door panel to a door frame, that may be used with the door on or off of the vehicle, comprising a rod having a connecting end and a retaining end; a weight disposed around the rod and movable along the rod to provide a force at the connecting end by movement of the weight against a stop shoulder located at the retaining end; a shank of sufficient length to enable said device to be used on the door panel edge located inside the body cavity when the door is open, having a connecting end and a crimping end; means attached at the connecting end of said shank for connecting the shank to the connecting end of said rod; a hook mounted with the crimping end of said shank having a flared end means of sufficient length for initially engaging a flanged edge of the door panel and beginning to fold the edge over a door frame lip; said flared end means generally curving outwardly from the shank side of said crimping portion and dimensioned for folding the edge over the lip and a crimping portion means of generally U-shaped cross-section with one side of the "U" extending into the shank and the other side of the "U" extending into the flared end means, said crimping portion means being of sufficient length for progressively engaging the door panel edge as the flared end means folds the edge over the door frame lip and to progressively crimp the edge to the lip, the folding and crimping of the edge to the door frame lip being accomplished by movement of the weight against the stop shoulder.

5. The device of claim 4, wherein said rod is threaded at the connecting end to form a bolt and said connecting means is a nut threadedly engaging the bolt.

6. The flanging tool of claim 4, wherein said shank is constructed to form an arcuate shape for displacing the retaining end of said impact tool from the door panel to inhibit damage to the door panel when attaching the door panel to the door frame.

* * * * *